US007621229B2

(12) United States Patent
Bowen et al.

(10) Patent No.: US 7,621,229 B2
(45) Date of Patent: Nov. 24, 2009

(54) SYSTEMS AND METHODS FOR TETHERING UNDERWATER VEHICLES

(75) Inventors: Andy Bowen, Woods Hole, MA (US); Louis Whitcomb, Baltimore, MD (US); Dana R. Yoerger, North Falmouth, MA (US); Robert McCabe, North Falmouth, MA (US)

(73) Assignee: Woods Hole Oceanographic Institution, Woods Hole, MA (US)

( * ) Notice: Subject to any disclaimer, the term of this patent is extended or adjusted under 35 U.S.C. 154(b) by 20 days.

(21) Appl. No.: 12/148,226

(22) Filed: Apr. 17, 2008

(65) Prior Publication Data

US 2009/0007835 A1 Jan. 8, 2009

Related U.S. Application Data

(60) Provisional application No. 60/925,055, filed on Apr. 17, 2007.

(51) Int. Cl.
*B63B 21/66* (2006.01)

(52) U.S. Cl. ..... 114/244; 114/312; 114/322

(58) Field of Classification Search ..... 114/244, 114/312, 322; 405/222, 224, 224.1
See application file for complete search history.

(56) References Cited

U.S. PATENT DOCUMENTS

| | | | | |
|---|---|---|---|---|
| 3,296,995 | A * | 1/1967 | Van Der Linde | 114/244 |
| 4,010,619 | A | 3/1977 | Hightower et al. | |
| 6,167,831 | B1 | 1/2001 | Watt et al. | |
| 6,257,162 | B1 * | 7/2001 | Watt et al. | 114/244 |
| 6,600,695 | B1 * | 7/2003 | Nugent et al. | 114/312 |
| 6,738,314 | B1 | 5/2004 | Teeter et al. | |
| 6,883,452 | B1 | 4/2005 | Gieseke | |

OTHER PUBLICATIONS

International Search Report from PCT/US2008/005103, mailed Oct. 7, 2008.

* cited by examiner

*Primary Examiner*—Lars A Olson
(74) *Attorney, Agent, or Firm*—Ropes & Gray LLP

(57) ABSTRACT

Systems for tethering an underwater vehicles using a low strength optical fiber tether. The tether system includes, a mechanical fuse that prevents a high load from acting on and severing the tether that is attached to the underwater vehicle, thus allowing use of far smaller cables than typically used. Upon separation of the fuse, a cable payout system pays out an optical fiber that keeps the underwater vehicle, typically a robotic craft, in communication with the surface vessel. The relatively light weight glass fiber may be reinforced and extended to lengths greater than 40 km allowing deep-sea exploration at depths up to 11,000 m.

16 Claims, 8 Drawing Sheets

SYSTEMS AND METHODS FOR TETHERING UNDERWATER VEHICLES

CLAIM OF PRIORITY

This application claims priority to U.S. Patent Application 60/925,055 entitled Light Fiber Tether For Undersea Robotic Craft, filed Apr. 17, 2007 and naming Andy Bowen, among others, as an inventor, the contents of which are hereby incorporated by reference in their entirety.

FIELD OF THE INVENTION

This invention relates to systems and methods for tethering, deployment and operation of underwater equipment. More particularly, the invention relates to systems and methods for providing tether connections to deep sea underwater vehicles and devices.

BACKGROUND

There is a growing scientific need to research extreme underwater environments at depths of about 11,000 m (36,000 feet). Particularly, there is an interest in studying subduction zones found in the deepest oceanic trenches around the world. These trenches are home to reserves of metallic ores, and house unique biological communities that flourish in these extreme conditions. There is also a growing interest in investigating magmatic, hydrothermal and volcanic activity in these deep locations and to perform oil exploration and production.

Existing robotic deep submergence vehicle systems have excellent capabilities and provide critical, routine access to the seafloor primarily in ranges up to 6,500 m. These systems utilize tether systems (attached to surface vehicles such as ships) that generally prevent full operation of devices at depths of past 7,000 m or so. Such prior art cable systems include steel cable systems. This steel cable tether is limited by the weight of the cable that increases substantially with increasing length of cable. At one point the weight of the cable begins to exert a force on the support ship that is well past the allowable limits. Other prior art systems include Kevlar cable systems. These Kevlar systems offer high strength to weight ratios. However, they are very expensive and have limited lifetimes. Moreover, the cross-section of the cables are relatively large resulting in a high-drag system that the undersea vehicle cannot easily move horizontally or tow. Further, the prior art systems also require large support ships that have typically, custom made cable handling systems. These support ships are costly to operate and to equip with the needed cable handling systems.

Accordingly there is a need for improved tether capable of deploying and securing vehicles at depths of up to 11,000 m for extended periods of time.

SUMMARY OF THE INVENTION

The systems and methods described herein include improved systems and methods for tethering deep sea underwater vehicles and devices. As noted earlier, many current tethering systems are unsuitable for use with vehicles diving to depths of 11,000 m or deeper because of the limitations imposed by the weight of the cable, its cross-sections and/or its cost. The systems and methods described herein overcome the deficiencies of the prior art systems. To this end, and in one embodiment, the systems and methods described herein provide a tether system for an underwater vehicle that employs a relatively light weight cable connected to an adjustable mechanical fuse that can separate upon application of a predetermined load and activate a constant tension fiber optic payout system that pays out a fiber optic cable that supports a communication channel to the underwater vehicle. In one particular embodiment, the tether system includes, among other things, a load-bearing optical fiber tether extending from a ship through a depressor that is detachably connected to the float pack, and thereby connected to an underwater vehicle. The optical fiber serves as a data communication link to the surface. The relatively light weight glass fiber may be reinforced and extended to lengths greater than 60 km. Advantageously, the sub-millimeter diameter fiber may be spooled into a volume that is sufficiently small to be packed into the depressor and/or the float pack. Buffered fiber optic tether may pay out between the depressor and the float pack.

More particularly the systems and methods described herein include systems for tethering an underwater vehicle to a support. In certain embodiments, the systems include a depressor having a proximate end and a distal end, the proximate end attached to the support vessel, a float pack connected to the depressor by one or more optical fibers, and having a latch at its distal end for releasably engaging the float pack and the depressor, such that in a first latched condition the float pack is physically joined to the depressor and in a second unlatched condition, the float pack is physically separated from the depressor such that the depressor may move relative to the float pack. A fiber canister is disposed in at least one of the depressor and the float pack for storing an excess length of the one or more optical fibers, wherein the float pack is attached to the underwater vehicle by the one or more optical fibers.

Optionally, the latch is an adjustable latch for adjustably setting the load required to cause the depressor to separate from the float pack when the latch is in the first latched condition.

The system may also include a fiber optic cable payout system for payout cable from the fiber canister responsive to the depressor moving relative to the float pack.

The system may also include a constant tensioner that is coupled to the cable payout system for applying a resistive force to the cable as it is being drawn from the fiber canister.

Typically, the proximate end of the depressor is attached to the support by a first cable and the first cable includes an armored steel cable, or some other robust cable. The depressor often is a cylindrical depressor configured for housing the fiber canister and the fiber canister is disposed within the depressor.

The float pack may be removably attached to the depressor by the release latch and the fiber canister includes a spool for winding the excess length of the one or more load-bearing optical fiber. The fiber canister may be sized or storing over 60 km of the one or more load-bearing optical fibers.

The optical fibers typically include glass fibers configured for high-bandwidth optical communication, and may have a cross-section diameter of about 250 microns, or any suitable size and the weight of about 11 km of the one or more optical fibers in water is about 173 g.

The float pack may have a buoyant configuration and includes a brake, fiber counter and cutter.

In another aspect, the invention provides methods of deploying an underwater vehicle from a ship, comprising providing a tethering system, including a depressor having a proximate end and a distal end, the proximate end attached to the ship, a float pack attached to the underwater vehicle, connected to the depressor by an optical fiber, and removably attached at the distal end, and a fiber canister disposed in at least one of the depressor and the float pack for storing an excess length of the optical fiber; launching the underwater vehicle to a first depth in water; and separating the float pack and underwater vehicle from the depressor thereby allowing the excess length of the optical fiber to pay out.

BRIEF DESCRIPTION OF THE DRAWINGS

The following figures depict certain illustrative embodiments of the invention in which like reference numerals refer to like elements. These depicted embodiments may not be drawn to scale and are to be understood as illustrative of the invention and as not limiting in any way.

DETAILED DESCRIPTION OF THE ILLUSTRATED EMBODIMENTS

To provide an overall understanding of the invention, certain illustrative embodiments will now be described. In particular, there is described a tethering system for an underwater deep sea vehicle that employs a mechanical fuse and a cable pay out system, to provide a tethering system capable of deploying the underwater vehicle through the air-water interface, and then severing the mechanical fuse and using the cable pay out system to provide a light weight communication tether that facilitates deep water dives and exploration. However, it will be understood by one of ordinary skill in the art that the apparatus described herein may be adapted and modified as is appropriate for the application being addressed and that the systems and methods described herein may be employed in other suitable applications, and that such other additions and modifications will not depart from the scope hereof.

As will be seen from the following description, in one aspect, the systems and methods described herein relate to systems for tethering underwater vehicles using an optical fiber tether. The tether system includes, among other things, an optical fiber tether extending from a ship through a depressor that is detachably connected to a float pack and thereby, to an underwater vehicle. The optical fiber serves as a data communication link to the surface. The relatively light weight glass fiber may be reinforced and extended to lengths greater than 60 km. Advantageously, the sub-millimeter diameter fiber may be spooled into a volume that is sufficiently small to be packed into the depressor and/or the float pack. Buffered fiber optic tether may pay out between the depressor and the float pack.

Figure 1A:
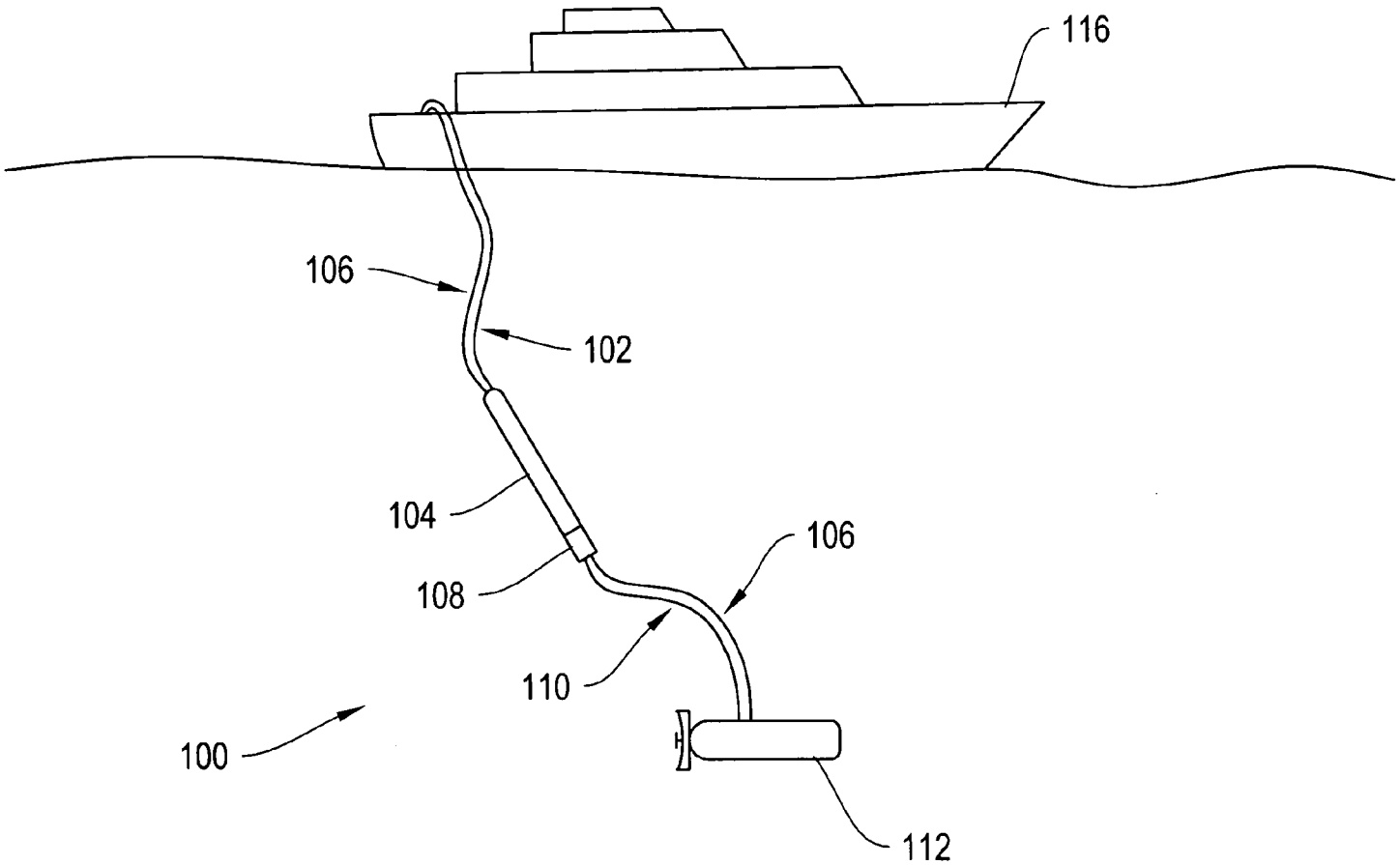
FIGS. 1A and 1B depict the deployment of an underwater vehicle using an exemplary tethering system.
Figure 1B:
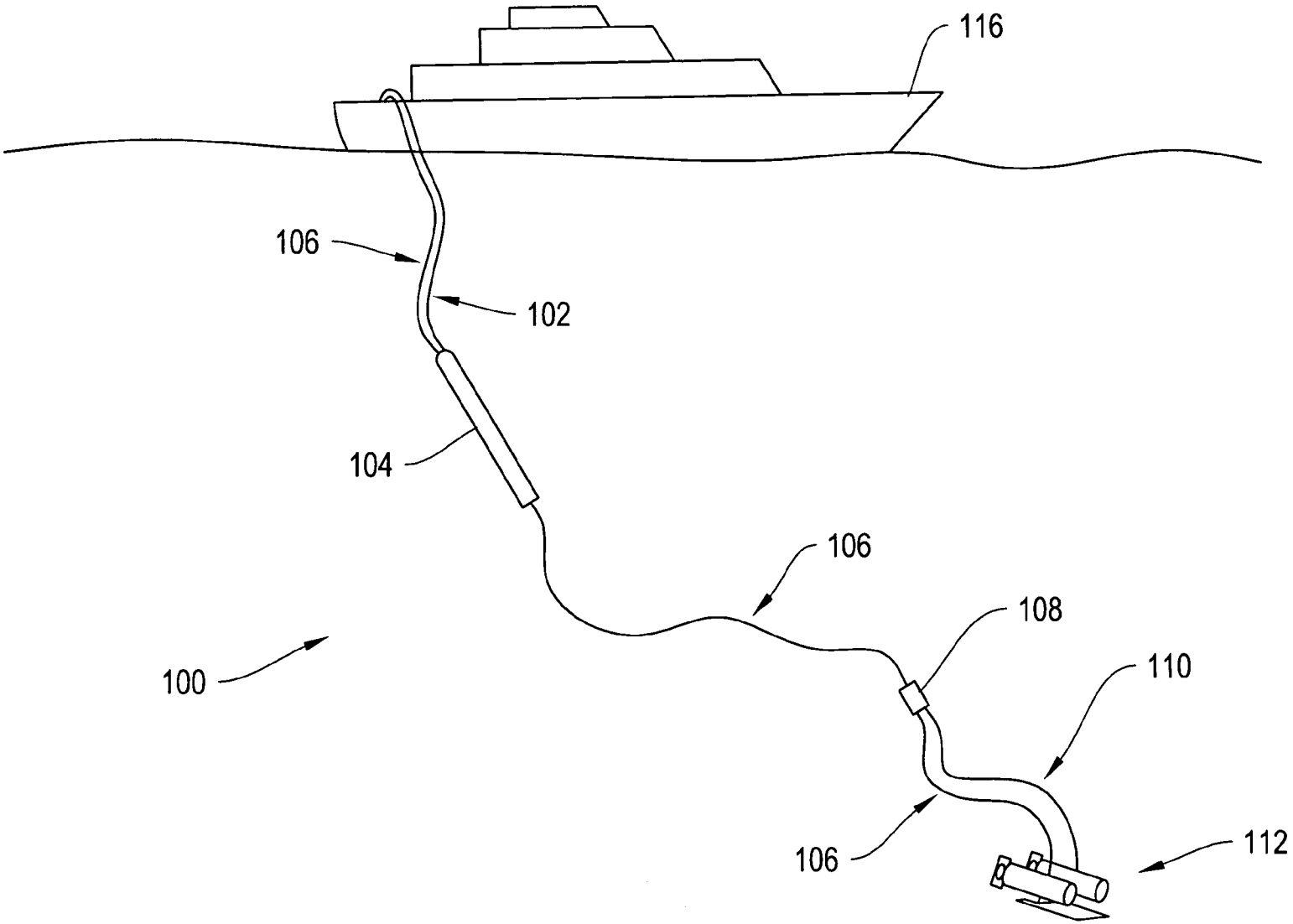

More particularly, FIGS. 1A and 1B depict the deployment of an underwater vehicle using an tethering system 100, according to an illustrative embodiment of the systems described herein. The system 100 tethers an underwater vehicle 112 to a ship 116. The system 102 includes a depressor 104, a float pack 108 and an optical fiber 106. The depressor 104 is attached to the ship 116 by a cable 102 and an optical fiber tether 106. In FIGS. 1A and 1B the cable 102 and optical fiber tether 106 are shown as separate elements. However, typically the cable 102 and optical fiber tether 106 are a single integrated cable. The underwater vehicle 112 may be any suitable underwater vehicle, and in certain embodiments the underwater vehicle may be a hybrid remotely operated vehicle (HROV) weighing between 1,000 and 5,000 kg.

In either case, when deployed, the ship 116 uses the cable 102 to lower the undersea vehicle 112 through the air-water interface. In one embodiment, the cable 102 includes a 0.68 fiber optic oceanographic cable used as a connection between the depressor and the ship. The cable may be installed on the ship's winch, along with a fiber optic slip ring to permit data transmission top side of the ship. Topside a optional screen display (not shown) may be located next to the winch controls for monitoring the status of the depressor 104, float pack 108 and fiber 106.

In one embodiment, the depressor 104 is designed to transport fiber optic cable spools below the active section of the water column, providing for additional strength through the air-water interface. It may be designed to minimize drag and the chance of snagging the fiber. One design is partially depicted in FIG. 4, which may be a depressor that is about 10 cm in diameter and 6 m long. The depressor 104 sinks underwater beneath the air-water interface to a designated depth depending on, among other things, the length of the cable 102 and/or the optical fiber 106. The float pack 108 is removably attached to the depressor 104 and is configured to float closer to the surface relative to the underwater vehicle 112 to keep the optical fiber tether 106 separate from portions of the underwater vehicle 112. Optionally, a second cable 110 connects the float pack 108 to the underwater vehicle 112. During operation, when the depressor 104 sinks to a desired depth, the float pack 108 de-latches from the depressor 104, as shown in FIG. 1B. The underwater vehicle 112 continues to descend pulling downward the de-latched depressor 108. As the depressor 108 descends, a constant tension fiber optic payout system shown in more detail in FIGS. 4-7, pays out the fiber optic cable 106 as the depressor 108 continues to descend below the float 104. thereby maintaining and supporting a communication channel to the underwater vehicle 112. In certain embodiments, excess lengths of optical fiber tether 106 are stored in the depressor 104 and/or the float pack 108 in a fiber canister. The excess length of the optical fiber 106 pays out from the fiber canister between the depressor 104 and float pack 108.

The optical fiber 106 and cable 102 together are configured to tether the underwater vehicle 112 and together are capable of bearing loads arising therefrom. In particular, the tether systems described herein are capable of bearing loads that arise from the sudden pulls and snatches that can occur when deploying an undersea vehicle from a surface ship in a marine environment, thus allowing lighter cables than conventionally used. In particular, the systems and methods described herein provide a novel, lightweight tether system that include a mechanical fuse that will separate upon application of a mechanical load that is above a pre-determined safe working load for the cable 106 being employed for lowering the underwater vehicle 112. As is known to mariners, a surface ship is subject to sudden changes in weather and conditions. These sudden changes in weather and conditions can result in the ship moving quickly away from its original designated position. When deploying an underwater vehicle, movement of the ship can generate forces and loads onto the cable used to deploy the underwater vehicle, such as the depicted cable 106. Further, the marine environment lends itself to sharp and sudden changes that can result in forces acting on the ship that accelerate the position of the ship away from its current location, and causing lurching and pitching of the vessel. This results in a force being applied to the cable that can cause the cable to snap, risking loss of the undersea vehicle or at least loss of communication with that vehicle as when the cable snaps this typically severs the communication link with the underwater vehicle. To this end, typical tether systems provide a cable, such as the prior art steel and Kevlar cables earlier discussed, that are sufficiently strong to withstand the forces that can sometimes arise in the marine environment. Thus, these prior art systems build the tether system for worst case scenarios, and this results in heavy cables that greatly interfere with the ability to deploy underwater vehicles.

The systems and methods depicted in FIG. 1 illustrate a technique to take care of a robotic cable in the embodiments described herein. If a snatch force applied to the cable exceeds a certain pre-determined safe working load, a mechanical fuse coupling the depressor to the float pack will release the float pack from the depressor. This prevents the force applied to the cable and float pack from transferring to the depressor and the underwater vehicle 112. Thus, the load of the underwater vehicle 112 is not resisting the snatch force applied to the cable 106, and the cable 106 is safe from harm. Once the mechanical fuse releases the depressor from the float pack, a constant tension fiber optic cable payout system built into the float and the depressor will pay out a fiber optic cable between the depressor and float. A fiber optic cable typically provides a communication link between the ship and the underwater vehicle 112. Sudden movements of the surface ship can cause force to be applied to the float pack. However the cable payout system will respond to an applied force by paying out additional fiber optic cable with sufficient ease to prevent the force of the moving ship to be applied to the load of the underwater vehicle 112. As described in greater detail hereinafter, the fiber optic payout system optionally includes a constant tension mechanism that maintains the fiber optic cable under sufficient tension to prevent the fiber optic cable from floating freely in the open underwater environment. In particular, the constant tension mechanism maintains the cable sufficiently taut to keep the cable extending upwardly towards the float pack and prevents the cable from landing on the ocean floor where, it is highly likely, the cable will be harmed.

In practice, the diameter of the optical fiber tether 106 and other physical and electrical specifications may be selected depending on, among other things, the desired application, the dimensions of other components of the system 100, depth of exploration and underwater conditions. Typically, the fiber optic cable is used to send data and commands between the surface ship and the underwater vehicle. Thus, the application in this embodiment benefits from a lightweight cable that is sufficiently robust to resist or prevent the negative effects on signal conduction that the high pressures of these advanced depths can create. In certain embodiments, the optical fiber 106 includes glass fibers having a diameter of about 250 microns. In other embodiments, the optical fiber 106 has a diameter from about 250 microns to about 900 microns. The diameter of the optical fiber 106 may be less than about 250 microns and greater than about 900 microns without departing from the scope of the invention. Typically, the larger the diameter of the optical fiber 106, the larger the size of the fiber canister for storing the excess length of the optical fiber 106. For example, about 20 km of an optical fiber 106 having a diameter of about 800 microns can be wound into a spool having a diameter of about 30 cms and height of about 15 cms.

The optical fiber 106 may be formed from any suitable material having, among other things, a high bending stiffness relative to its diameter. In certain embodiments, the optical fiber 106 may be selected for other desirable properties including, but not limited to, its specific gravity, pressure tolerance, weight, optical attenuation, working strength, breaking strength and resistance to corrosion. In certain embodiments, the weight of 11 km of the optical fiber tether 106 is from about 0.17 kg to about 5 kg. The weight of 11 km of the optical fiber tether 106 may be selected to be about 0.173 kg. Optionally, the weight of 11 km of the optical fiber tether 106 may be selected to about 4.23 kg. The working strength of the optical fiber 106 may be from about 5 N to about 150 N. The breaking strength of the optical fiber 106 may be from about 100 N to about 400 N.

In certain embodiments, the optical fiber tether 106 is from about 20 km to about 60 km long and extends from the ship 116 to the underwater vehicle 112. In such embodiments, the optical fiber 106 additionally serves as a communication link between surface ship 116 and the underwater vehicle 112. Therefore, the optical fiber 106 may be configured to transmit high bandwidth data. The data transmission may include high bandwidth digital data including real-time video, scientific data, navigation data and command and control data. In certain embodiments, the optical fiber 106 may be additionally used to transmit power. The optical fiber 106 may be formed from materials allowing for continuity of the fiber optic link across the length of the tether 106. In certain embodiments, the optical fiber 106 is formed from materials having low cable attenuation in deep underwater conditions and/or under a tensile load.

Figure 2:
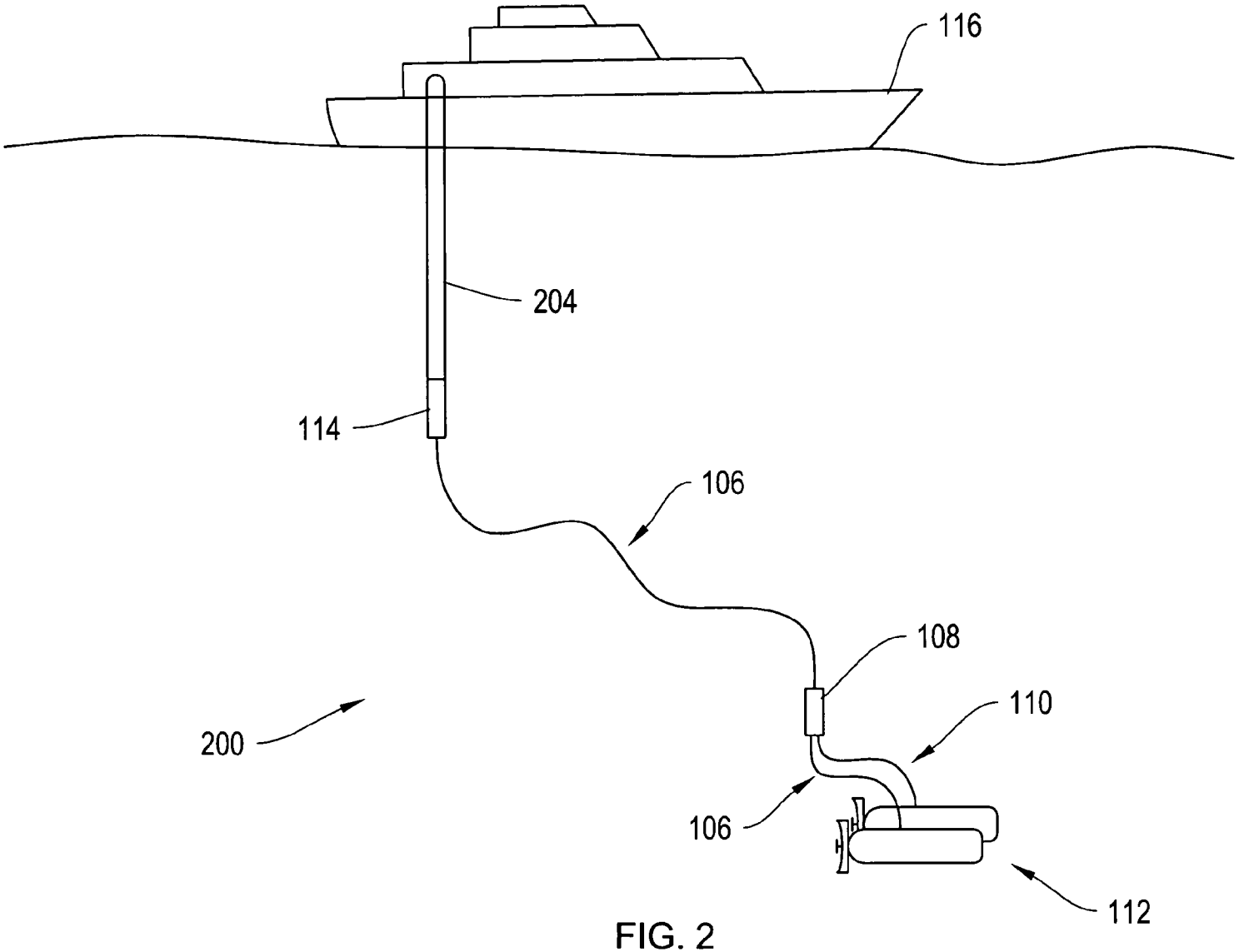
FIG. 2 depicts an alternate embodiment of an underwater vehicle tethering system.

The depressor 104 may be configured to sink in water such that the depressor 104, the tethering system 100 and the underwater vehicle 112 are clear of the ship 116 and away from the influence of underwater currents near the surface. In certain embodiments, the depressor 104 may include a long cylindrical depressor 104 that is attached to the ship 116 by cable 102. The cable 102 may be an armored cable including steel cable. The depressor 104 is sized and shaped to travel to a set depth below the air-water interface and away from the ship's bottom. The depressor 104 may optionally function as a conventional depressor being capable of traveling to and staying at the selected depth. In certain embodiments, as depicted in tethering system 200 of FIG. 2, the depressor may include a cylindrical depressor 204 directly attached to the ship 116 and extending underwater away from the bottom of the ship. The depressor 204 may extend to any desired depth according to requirements of a particular application.

In certain embodiments, the depressor 104 has a proximate end and a distal end. The proximate end includes an attachment to the cable 102 for securing to the ship 116. The distal end of the depressor 104 may removably attach to the float pack 108. In certain embodiments, the depressor 104 includes a release latch such that the float pack 108 can attach and detach from the depressor 104 as needed. The release latch can couple the float pack to the depressor and any suitable release latch may be employed. In certain embodiments, for deployment, the distal end of the depressor 104 or 204 may include an attachment assembly to removably attach to the underwater vehicle 112.

The depressor 104 may be configured to house a fiber canister for storing excess length (or buffer) of optical fiber 106 that can pay out to increase the length of the tether. The depressor 104 may also be configured to house related mechanical, electrical and electronic systems to regulate the pay out of the buffer optical fiber 106 from the fiber canister. Exemplary pay out schemes will be described in more detail with reference to FIGS. 3A-3C. In certain embodiments, the depressor 104 is configured to allow the optical fiber 106 to pass through the length of the depressor 104.

The depressor 104 may be removably connected to a detachable buoyant float pack 108 for lifting the optical fiber tether above the propulsion machinery of the underwater vehicle. In certain embodiments, the float pack 108 has a proximate end and a distal end. The proximate end is attached by the optical fiber tether 106 to the depressor 104. The distal end of the float pack 108 is attached to the underwater vehicle 112 by the tether 106. In certain embodiments, the float pack 108 includes a release latch such that the it can attach and detach from the depressor 104 as needed. The release latch can couple the float pack 108 to the depressor 104 and any suitable release latch may be employed. The float pack 108 may be configured to house a fiber canister for storing excess length (or buffer) of optical fiber 106 that can pay out to increase the length of the tether. The float pack 108 may also be configured to house related mechanical, electrical and electronic systems to regulate the pay out of the buffer optical fiber 106 from the fiber canister. In certain embodiments, the float pack 108 may include a cutter for cutting the tether to allow the underwater vehicle 112 to function manually.

Figure 3A:
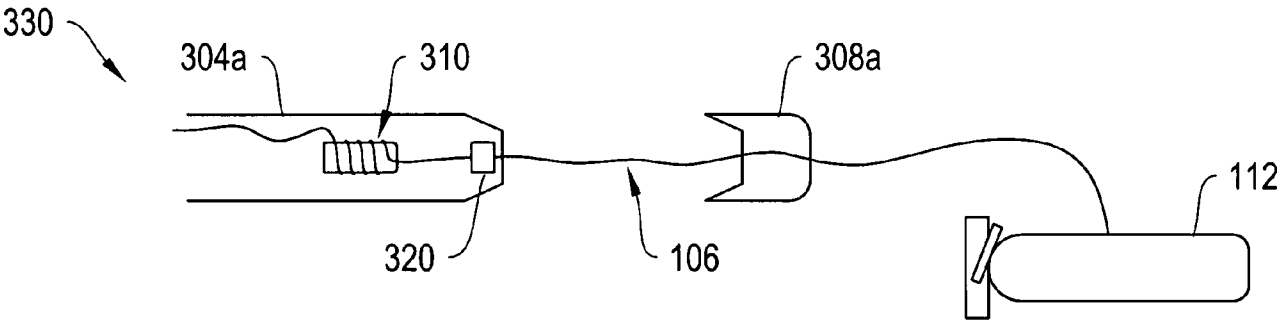
FIGS. 3A-3C depict tether pay out schemes, according to an illustrative embodiment of the invention.
Figure 3B:
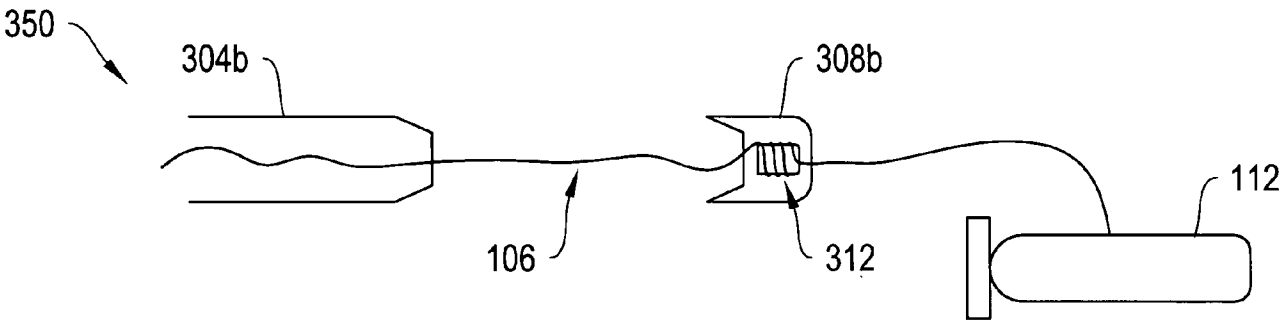
Figure 3C:
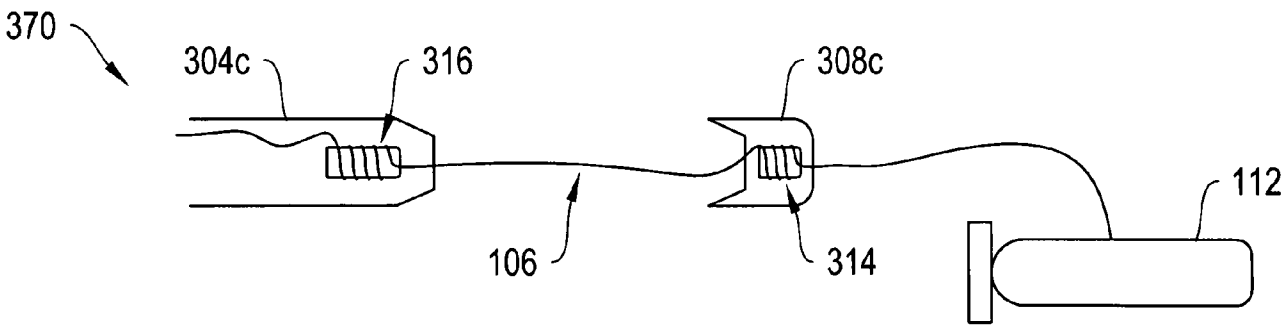

As noted earlier, a fiber canister housing excess lengths of optical fiber 106 may be disposed in either the depressor 104 or the float pack 108, or both. In certain embodiments, the fiber canister includes a spool configured to allow the buffer optical fiber 106 to pay out. The fiber canister may be sized and shaped as desired without departing from the scope of the invention. FIGS. 3A-3C depict various schemes for housing such fiber canisters 310, 312, 314 and 316 in the depressor 304*a*-304*c* and/or the float pack 308*a*-308*c*. In particular, FIG. 3A depicts a system 330 including a depressor 304*a* and a float pack 308*a*, connected to an underwater vehicle 112. The depressor 304*a* includes a fiber canister 310 and a brake system 320 for dispensing and regulating the pay out of the optical fiber tether 106. During operation, the brake may monitor the tension in the fiber 106 and limit the pay out of the tether 106 when a programmable tension set point is reached. In certain embodiments, the tension set point may be about 180 g. In such embodiments, when the tension set point is reached, the payout tension may be constant and speed independent. The brake system 320 may be connected to electrical and electronic circuitry configured for controlling the tension in the fiber 106. FIG. 3B depicts a system 350 wherein a fiber canister 312 is housed within the float pack 308*b*. FIG. 3C depicts a system 370 wherein fiber canister 314 is disposed in the float pack 308*c* and fiber canister 316 is housed in the depressor 304.

During operation, prior to deployment, the depressor may be attached to the float pack and the underwater vehicle. The excess length of the optical fiber tether is stored within the depressor and/or float pack. During deployment, the underwater vehicle 112 and the tethering system 100 are launched into the water and allowed to sink. The armored cable depressor sinks to a designated depth depending on, among other things, the length of the armored cable to keep the tethering systems and the underwater vehicle clear of the ship and any surface currents. In certain embodiments, the commercially available cables may be combined with the optical fiber tether to assist in combating surface currents and rough seas. Once the depressor reaches the designated depth, the float pack detaches from the depressor allowing the optical fiber tether to pay out. In certain embodiments, the rate of payout may be regulated by a braking system connected to the fiber canister along the length of the optical fiber tether. The underwater vehicle may include an anchoring system to allow it to sink deeper. Once the underwater vehicle reaches the seafloor, or a portion of a trench or a desired location under the ocean, the anchoring system may be released from the vehicle.

Figure 4:
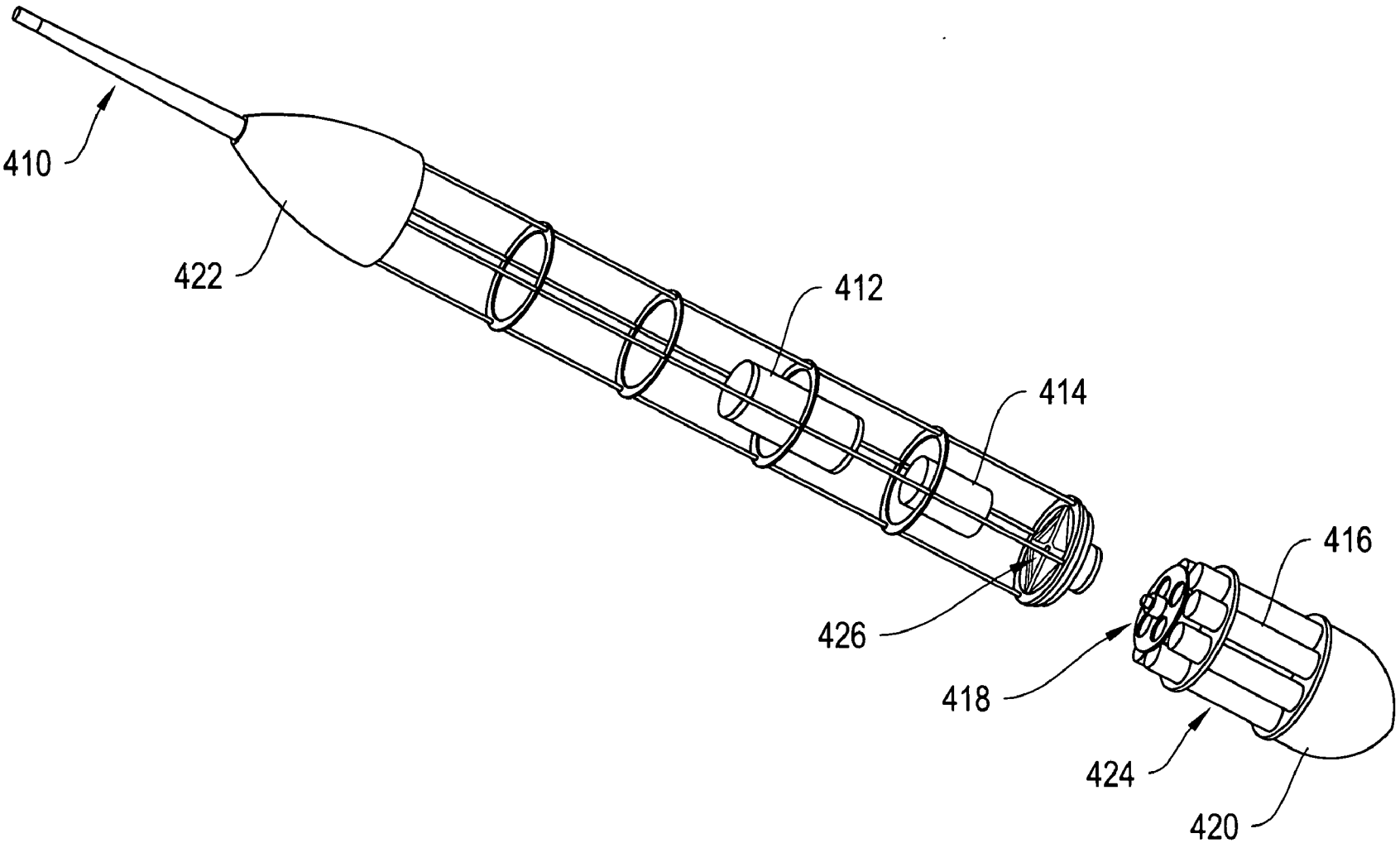
FIG. 4 depicts pictorially and in more detail embodiments of a float packs and a depressor suitable for use with the systems described herein.
Figure 7:
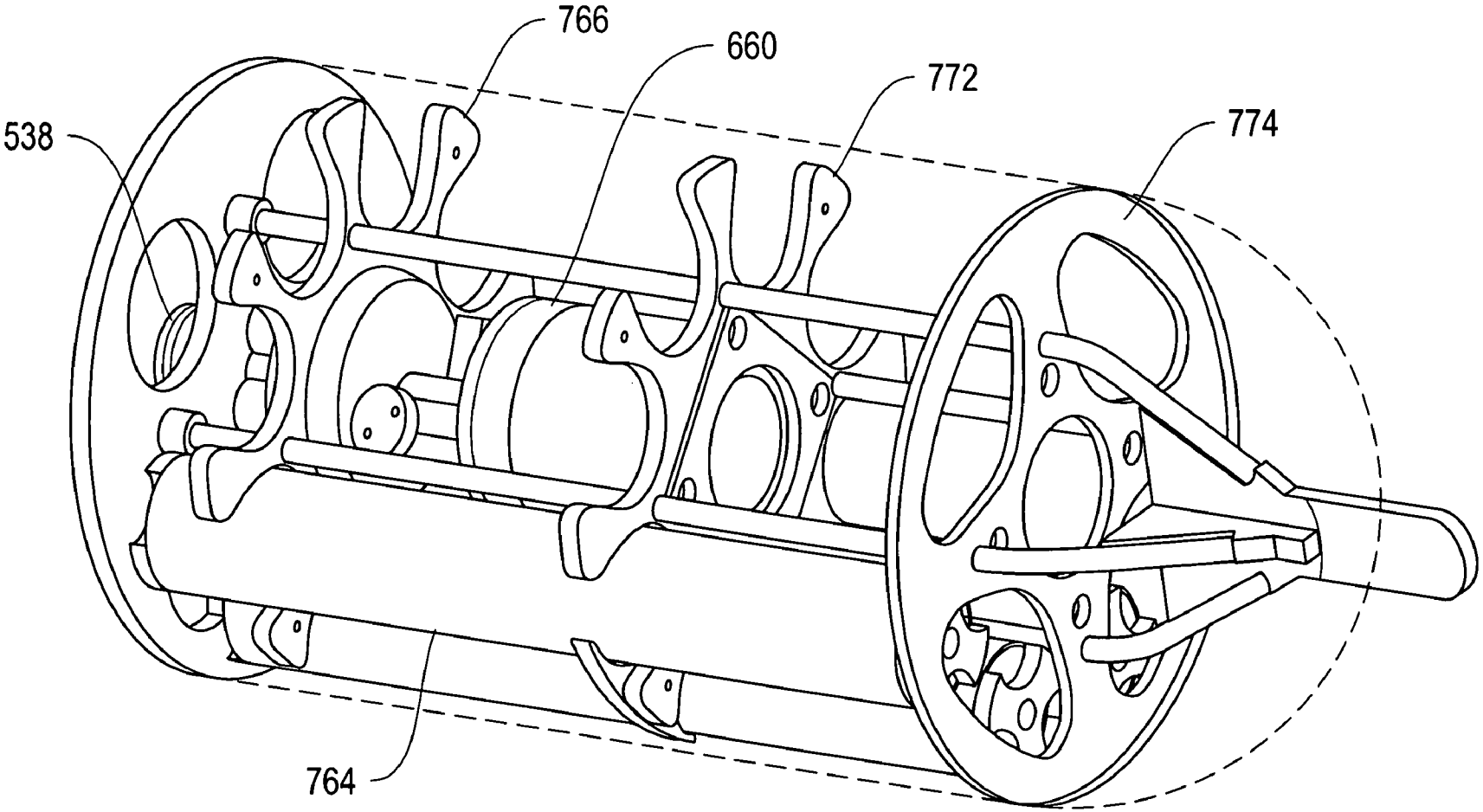
FIG. 7 depicts pictorially one embodiment of a float pack suitable for use with the systems described herein.

Turning to FIG. 4, there is depicted pictorially one example embodiment of a float pack 422 and a depressor 424. In particular, FIG. 4 depicts the float pack 416 and depressor 424 as separate from each other. The fiber optic cable that in operation would extend between the float pack and the depressor is not depicted. For the purposes of clarity, the housing skin that normally would cover the float pack 416 and depressor 424 are removed and FIG. 4 depicts the internal elements of the float pack 416 and depressor 424. In particular FIG. 4 depicts the cable 410 that couples to the depressor and to the ship. As discussed above, the cable 410 is relatively lightweight as the mechanical fuse that couples the float pack 416 to the depressor 424 will prevent a snatch force that exceeds a safe working load from being applied to the underwater vehicle (not shown). The cable 410 connects to one end of the depressor 416. An assembly of electronics 412 that can include the electronics for running communications, powering other elements of the float pack 416 and other functions is also shown. FIG. 4 also depicts the canister brake assembly 414 and the latch assembly 426. The float pack 424 includes a plurality of floats 416 and a connecting spike 418 that can couple with the latch 426. Not shown in FIG. 4 is that an identical canister brake assembly such as the brake assembly 414 of the depressor 422 416 is also included internally within the float pack 424. In FIG. 4 that internal canister brake assembly is surrounded by an obscured by the floats 416. FIG. 7 shows these components in more detail.

Figure 5:
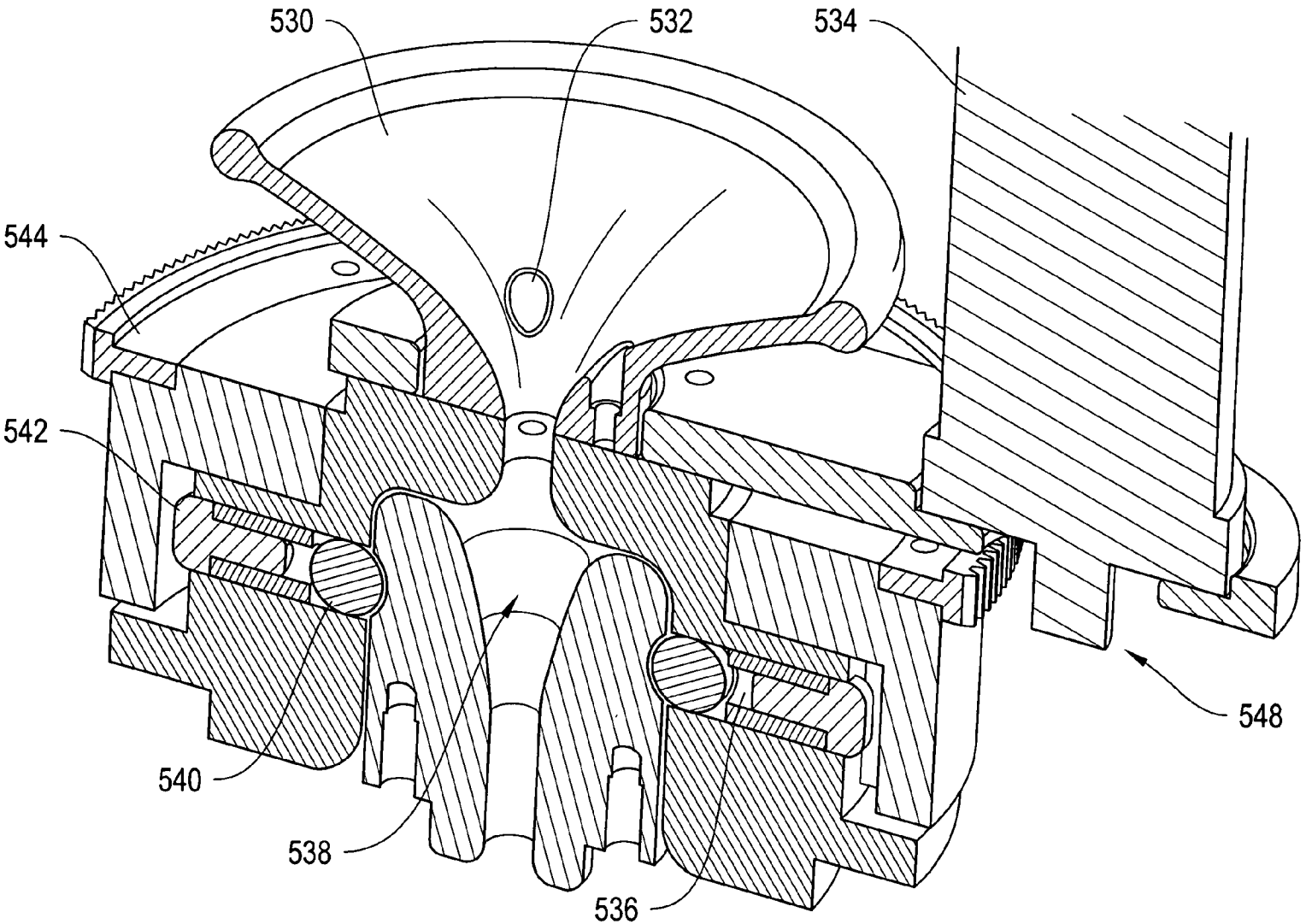
FIG. 5 depicts pictorially and in cross-section one embodiments of a latch for releasably coupling a float packs and a depressor.

FIG. 5 shows in more detail the latch mechanism 426 presented in FIG. 4. In particular FIG. 5 shows a cross section of the latch assembly 426 in its latched state. That is, the upper portion of the latch assembly depicted in FIG. 5 represents that portion of the latch assembly contained within and at the far end of the depressor 422 depicted in FIG. 4. The spike 418 depicted in FIG. 4 is represented in FIG. 5 as the element 538 which is the upper portion of the spike 418 and which acts as the male component of a connector fitting into the female component of the latch assembly depicted in FIG. 5. In particular FIG. 5 depicts a motor 534, a guide cone 530, a ring gear rotary cam 544, a follower 542, a movable ball 540, the spike 538 from the depressor, and springs 536. The motor 534 is shown in cross section. Additionally, the lower portion of the motor 548 is normally equipped with a gear that mates with the ring gear 544 in such a way that the turning of motor 534 will drive the ring gear rotary cam 544.

The spike 538 is held in place by the balls 540. The balls 540 are fitted within a groove that extends around the circumference of the spike 538. The balls 540 are pushed into that groove by the action of the springs 536 and the followers 542. The followers 542 are cam followers. The cam is the interior wall of the ring gear rotary cam 544 as is known in the art the interior wall of the ring gear rotary cam 544 will have a changing thickness or pitch. Thus as the motor 534 drives the ring gear rotary cam 544 in a clockwise or counterclockwise direction, the interior wall of the ring gear rotary cam 544 will alternately drive the followers 542 inwardly or outwardly from the balls 540, with the springs 536 driving the followers outwardly when the pitch of the wall allows the followers to move away from the groove surrounding the spike 538.

The latch assembly depicted in FIG. 5 is therefore capable of being adjusted to achieve a selected breakaway force. The selected breakaway force represents the load that will cause the spike 538 to pull away from and out of the ball and groove latch assembly.

In the embodiment depicted in FIG. 5 the latch includes a motor controlled cam and follower assembly. However, in other embodiments, the latch may include electromechanical solenoids, or automatable explosive charges, or any suitable mechanism for releasably joining the depressor and the float pack such that such that in a latched condition the float pack is physically joined to the depressor and in the unlatched condition, the float pack is physically separated from the depressor such that the depressor may move relative to the float pack.

In typical operation, when the underwater vehicle is first being deployed through the sea-water interface, the motor 534 moves the ring gear rotary cam 544 into a high tension position, thereby securely locking the spike 538 within the latch. When the operator chooses to stop the winch, the lowering of the cable will cease. At that point the underwater vehicle 112 operating under the control of its own motor will apply a force to the latch and will pull the spike 538 out from the latch thereby releasing the depressor from the float.

Figure 6:
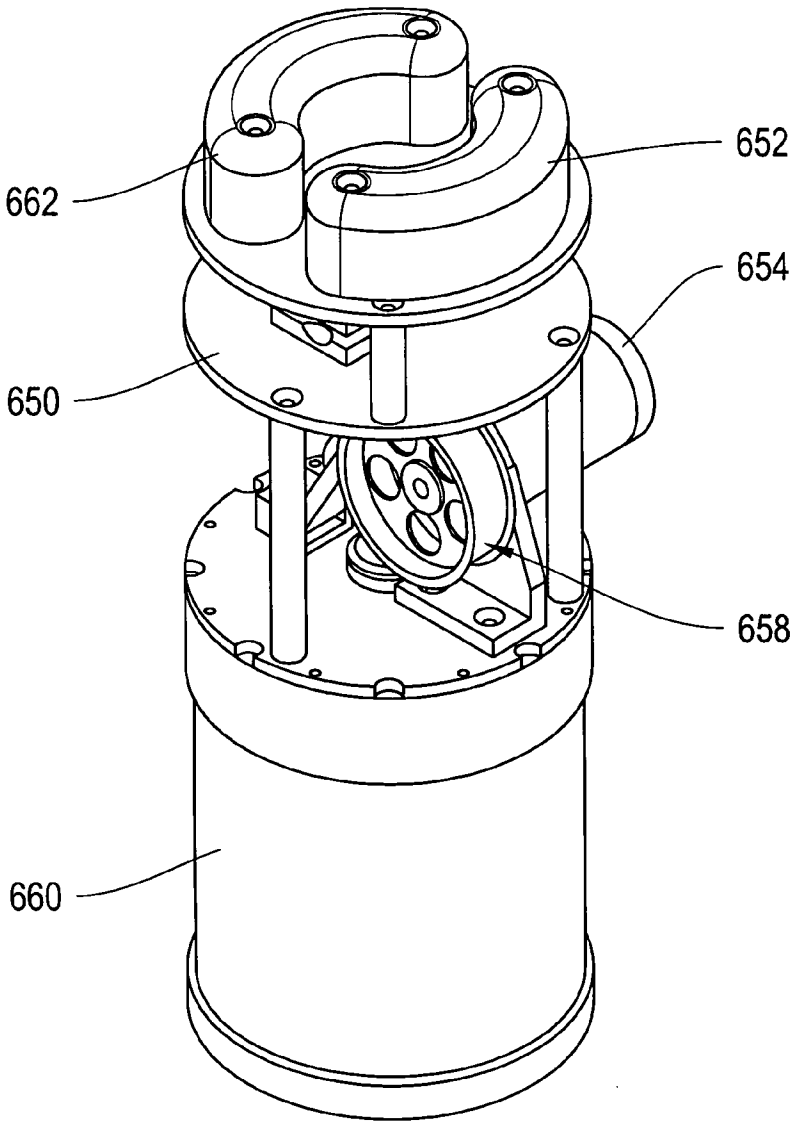
FIG. 6 depicts pictorially and in more detail one embodiment of a constant tension fiber optic cable brake and cutter.

Once the depressor and the float are separated the payout device begins to pay fiber optic cable. To prevent the cable from flowing freely enough that it snags on sub sea structures or the sea floor, the systems and methods described herein provide a constant tension braking system that provides sufficient tension on the cable to prevent it from flowing completely freely, while at the same time allowing the cable to payout freely and in response to a force that is less than the force that it would take to snap the fiber optic cable or otherwise harm it. FIG. 6 depicts in greater detail one embodiment of a fiber optic canister brake assembly with a cutter mechanism. In particular, FIG. 6 depicts a canister brake assembly having a capstan drum 658, a tension assembly 654, an upper plate 652 carrying two kidney shaped cleats, a cutter 650 and a canister housing 660. The canister housing 660 houses a large bobbin that stores the spool of fiber optic cable on a spool that will allow the cable to be pulled vertically off the spool. The fiber optic cable on the rotating access spools off fiber upwardly through a slot (not shown) in the lower plate 670 of the canister assembly. The fiber optic cable moves upwardly and wraps around the capstan drum 658 two or three times. Then the fiber optic cable travels upwardly through the cutter 650 and through a central aperture in the upper plate 672 (not shown) and between the two kidney shaped cleats 662. The capstan drum 658 couples to a drag assembly or brake assembly 654. In one embodiment the drag assembly 654 is a spring assembly that provides a resistive torque that will provide a uniform resistance to a torque applied to the capstan drum 658. Typically, the resistance provided by the mechanism 654 is to resist a torque applied to the fiber optic cable by the motion of the underwater vehicle 112. In the embodiment depicted in FIG. 6 the tensioning mechanism 654 is a spring assembly that uses the mechanical spring to keep a constant tension on the capstan drums 658. However this is merely one embodiment of a system capable of providing such a resistance to a torque. In other embodiments electromechanical devices may be used, gearing mechanisms may be used, hydraulic systems may be used, or any other suitable mechanism for providing such a resistive torque.

The kidney cleats are provided for allowing excess fiber cable to be wrapped around the cleat so that the assembly of the float pack and depressor can be made after the fiber cable in the float pack has been fused to and joined with the fiber cable in the depressor. The result of this joining often provides an excess of fiber cable that needs to be neatly dealt with, and one common choice is to wrap the excess cable around cleat light rubber structures such as the kidney shaped cleats 662 depicted in FIG. 6.

The cutter 650 is an actuatable system that can cut the fiber cable after the underwater vehicle 112 has performed its mission. In one embodiment the float pack has the cutter mechanism 650 and the depressor has a gripper that will grip onto the fiber optic cable to allow the cable to be retrieved thereby reducing the likelihood of debris being left behind after the mission is complete. In one embodiment, the cable payout system from the depressor employs a SCI Sanmina cable pack, outfitted with a tension brake assembly and cable cutter. A tension of 180 g was set on the brake, to allow for the desired rate of cable payout. Cable payout may be in the range of a fraction of a meter per second, to several meter per second.

FIG. 7 depicts in more detail one embodiment of a float pack. In one embodiment, the float pack consists of a buoyant shape that contains an optical fiber dispenser, brake, fiber counter and cutter. It is connected to the with a 20 meter length of undersea tether. One optical fiber in the tether will be used to connect the fiber dispenser to an instrumentation housing on the vehicle. The tether's conductors may be used to convey the signals and data between different components of the tether system. The FIG. 7 depicts the float pack without its exterior housing and shows structural plates 772, 774 and 766. The plates 766 and 722 are shaped to receive the floats 764 which are traditional floats providing balance for the float pack. The spike 538, earlier depicted in FIG. 5 is shown, although partially obscured, at the distal end of the float pack. Internal to the float pack is the canister assembly 660 earlier shown in FIG. 6.

Variations, modifications, and other implementations of what is described may be employed without departing from the spirit and scope of the invention. More specifically, any of the method, system and device features described above or incorporated by reference may be combined with any other suitable method, system or device features disclosed herein or incorporated by reference, and is within the scope of the contemplated inventions. For example, the payout system may be used to pay out a Kevlar cable or leash, or other tether that is used merely to secure the underwater vessel to the ship. As such, the tether system provides a tether that can protectively sever upon application of a strong force, reducing the likelihood of damage to the cable or vessel. Additionally, the systems described here in employ a single latch, however, in alternate embodiments, several latches may be employed at different points along the tether system.

Thus, the systems and methods may be embodied in other specific forms without departing from the spirit or essential characteristics thereof. The foregoing embodiments are therefore to be considered in all respects illustrative, rather than limiting of the invention. The teachings of all references cited herein are hereby incorporated by reference in their entirety.

The invention claimed is:

1. A system for tethering an underwater vehicle to a support, comprising a depressor having a proximate end and a distal end, the proximate end attached to the support, a float pack connected to the depressor by one or more optical fibers, and having a latch at its distal end for releasably engaging the float pack and the depressor, such that in a first latched condition the float pack is physically joined to the depressor and in a second unlatched condition, the float pack is physically separated from the depressor such that the depressor may move relative to the float pack, and a fiber canister disposed in at least one of the depressor and the float pack for storing an excess length of the one or more optical fibers, wherein the float pack is attached to the underwater vehicle by the one or more optical fibers.

2. The system of claim 1, wherein the latch comprises an adjustable latch for adjustably setting a load required to cause the depressor to separate from the float pack when the latch is in the first latched condition.

3. The system of claim 1, further comprising a fiber optic cable payout system for payout cable from the fiber canister responsive to the depressor moving relative to the float pack.

4. The system of claim 3, further comprising a constant tensioner coupled to the cable payout system for applying a resistive force to the cable as it is being drawn from the fiber canister.

5. The system of claim 1, wherein the proximate end of the depressor is attached to the support by a first cable.

6. The system of claim 2, wherein a first cable includes an armored steel cable or a Kevlar reinforced cable.

7. The system of claim 1, wherein the depressor includes a cylindrical depressor configured for housing the fiber canister.

8. The system of claim 1, wherein the fiber canister is disposed within the depressor.

9. The system of claim 1, wherein the float pack is removably attached to the depressor by the release latch.

10. The system of claim 1, wherein the fiber canister includes a spool for winding the excess length of the one or more optical fibers.

11. The system of claim 1, wherein the fiber canister is configured for storing over 60 km of the one or more optical fibers.

12. The system of claim 1, wherein the one or more optical fibers include glass fibers configured for high-bandwidth optical communication.

13. The system of claim 1, wherein the one or more optical fibers has a cross-section diameter of about 250 microns.

14. The system of claim 1, wherein the weight of about 11 km of the one or more optical fibers in water is about 173 g.

15. The system of claim 1, wherein the float pack has a buoyant configuration and includes a brake, fiber counter and cutter.

16. A method of deploying an underwater vehicle from a ship, comprising providing a tethering system, including a depressor having a proximate end and a distal end, the proximate end attached to the ship, a float pack attached to the underwater vehicle, connected to the depressor by an optical fiber, and removably attached at the distal end, and a fiber canister disposed in at least one of the depressor and the float pack for storing an excess length of the optical fiber;

launching the underwater vehicle to a first depth in water; and separating the float pack and underwater vehicle from the depressor thereby allowing the excess length of the optical fiber to pay out.

* * * * *

UNITED STATES PATENT AND TRADEMARK OFFICE

CERTIFICATE OF CORRECTION

PATENT NO. : 7,621,229 B2
APPLICATION NO. : 12/148226
DATED : November 24, 2009
INVENTOR(S) : Andy Bowen et al.

It is certified that error appears in the above-identified patent and that said Letters Patent is hereby corrected as shown below:

In the specification

In Column 1, line 11, before "FIELD OF THE INVENTION" the following should be inserted:

--STATEMENT OF RIGHTS TO INVENTIONS MADE UNDER FEDERALLY SPONSORED RESEARCH
This invention was made with Government support under Grant No. OCE-0334411 awarded by the National Science Foundation. The Government has certain rights in this invention.--

Signed and Sealed this
Seventh Day of June, 2016

Michelle K. Lee

Michelle K. Lee
*Director of the United States Patent and Trademark Office*